US006083049A

United States Patent [19]

Kuo et al.

[11] Patent Number: 6,083,049

[45] Date of Patent: Jul. 4, 2000

[54] CABLE CONNECTOR

[75] Inventors: Peter Kuo, Chung-Ho; Alan Shih, Lin-Ko, both of Taiwan

[73] Assignee: Hon Hai Precision Ind. Co., Ltd., Taipei Hsien, Taiwan

[21] Appl. No.: 09/413,721

[22] Filed: Oct. 5, 1999

[30] Foreign Application Priority Data

Apr. 29, 1999 [TW] Taiwan ..... 88206728

[51] Int. Cl.[7] ..... H01R 13/648

[52] U.S. Cl. ..... 439/610; 439/939

[58] Field of Search ..... 439/610, 939, 439/181, 92

[56] References Cited

U.S. PATENT DOCUMENTS

| | | | |
|---|---|---|---|
| 4,571,012 | 2/1986 | Bassler et al. | 439/939 |
| 5,055,070 | 10/1991 | Plegge et al. | 439/610 |
| 5,695,362 | 12/1997 | Hillbish et al. | 439/939 |
| 5,899,772 | 4/1999 | Beaver et al. | 439/610 |

*Primary Examiner*—Gary F. Paumen
*Attorney, Agent, or Firm*—Wei Te Chung

[57] ABSTRACT

A shielded cable connector comprises a dielectric housing receiving a plurality of contacts therein, an inner shell module consisting of upper and lower shells for enclosing the housing and the contacts, and an outer shield module consisting of upper and lower shields for enclosing the housing and the inner shell module. The housing forms a mating portion for receiving the contacts. The lower shell of the inner shell module forms a guiding portion extending beyond the mating portion. A vertical plate perpendicularly extends outward from the guiding portion. A pair of V-shaped resilient grounding arms outwardly projects from the vertical plate to contact a metallic mating interface panel of an electronic instrument when the cable connector engages with a mating connector fixed to the panel. Thus, the grounding arms dissipate electrostatic charges accumulated on the cable connector and the cable before the cable connector engages with a mating connector mounted in the electronic instrument. Each grounding arm comprises a connecting section extending from the vertical plate, an outwardly projecting contacting section extending from the connecting section for contacting the mating interface panel of the electronic instrument, and an inwardly bent free end for allowing the grounding arm to deflect until substantially lying in the same plane as the vertical plate when the cable connector contacts the mating interface panel.

4 Claims, 4 Drawing Sheets

CABLE CONNECTOR

BACKGROUND OF THE INVENTION

The present invention relates to a cable connector, and particularly to a cable connector having a grounding system for dissipating electrostatic charges accumulated thereon before the cable connector engages with the mating connector.

DESCRIPTION OF THE PRIOR ART

Electronic instruments, such as computers and peripheral equipments thereof, commonly transmit high frequency electrical signals whereby an electromagnetic field may be created during normal operation. The electromagnetic field may adversely affect the signal transmission of other electronic instruments, while the high frequency electrical signals are apt to cause an accumulation of a large quantity of electrostatic charges on the electronic instruments and electrical elements proximate the electronic instruments. Therefore, additional shielding and grounding systems are required in most electronic instruments.

Cable connectors are used in a variety of electronic instruments. A large quantity of electrostatic charges is invariably accumulated on the cable connectors during operation. Since the accumulated electrostatic charges may create sparks when the cable connector engages with a mating connector thereby decreasing signal transmission quality, a shielding system having a grounding function is required to dissipate the accumulated electrostatic charges.

Conventional cable connectors having such a shielding and grounding system are disclosed in Taiwan Patent Application Nos. 76105370, 77204450, and 77210069. The conventional cable connector commonly comprises a dielectric housing receiving a plurality of contacts therein, and a metallic shell enclosing the housing and the contacts. The shielding and grounding system of the conventional cable connector usually comprises the shell and one or more grounding wires of a cable terminated at the cable connector. The shell is connected with the grounding wires of the cable and forms an outwardly projecting flange to enclose mating portions of the contacts, which extend outside of the housing for mating with the mating connector. Thus, when the mating connector engages with a cable connector, a metallic shied or a metallic panel to which the mating connector is fixed, contacts the shell of the cable connector thereby forming a grounding path through the shield or the panel, the shell of the cable connector and the grounding wires of the cable. The electrostatic charges accumulated on the cable connector and the mating connector are discharged via the grounding path thereby ensuring proper signal transmission.

Another shielded cable connector is disclosed in U.S. Pat. No. 5,055,070. The shielded cable connector comprises an electrical connector, first and second metal shells, and a pair of metal shields. The metal shells and the metal shields provide the cable connector with excellent shielding effects as well as grounding capabilities.

Although the conventional cable connectors described above facilitate electrostatic discharge when engaged with the corresponding mating connectors, electrostatic charges accumulated on the cable connector and the mating connector are apt to produce sparks when the cable connector is close toward the corresponding mating connector thereby damaging contacting elements of the connectors and resulting in unstable and unreliable signal transmission.

Therefore, a cable connector having a shielding and grounding system for dissipating electrostatic charges accumulated on the cable connector, a mating connector and/or a metallic panel, to which the mating connector is fixed, before engagement therebetween is required.

BRIEF SUMMARY OF THE INVENTION

A main object of the present invention is to provide a cable connector having a shielding and grounding system for dissipating electrostatic charges accumulated on the cable connector, a mating connector and/or a metallic panel, to which the mating connector is fixed, before the cable connector engages with the mating connector thereby ensuring stable and reliable signal transmission therebetween.

Another object of the present invention is to provide a cable connector having a shielding and grounding system consisting of symmetrically arranged grounding members for ensuring stable electrical contact with a mating connector.

A cable connector in accordance with the present invention comprises a dielectric housing receiving a plurality of contacts therein, an metallic inner shell module consisting of upper and lower shells for enclosing the housing, and a metallic outer shield module consisting of upper and lower shields for enclosing the housing and the inner shell module. The housing comprises a mating portion with mating ends of the contacts disposed thereon. The lower shell of the inner shell module is attached to a bottom surface of the housing, and forms a grounding portion outwardly extending beyond the mating portion of the housing. A vertical plate perpendicularly extends from the grounding portion. A pair of V-shaped resilient grounding arms is symmetrically formed on the vertical plate and outwardly projects therefrom for contacting a metallic mating interface panel of an electronic instrument. Thus, the outer shield module and the inner shell module together comprise a shielding and grounding system thereby ensuring excellent signal transmission.

According to one aspect of the invention, the grounding arms are symmetrically stamped and integrally formed with the vertical plate. Each grounding arm comprises a connecting section extending from the vertical plate, an outwardly projecting contacting section extending from the connecting section and slightly beyond the vertical plate, and an inwardly bent free end extending from the contacting section. A mating connector is attached to the metallic interface panel of the computer with a mating section partially extending through a mating port defined in the interface panel for engaging with the mating portion of the cable connector. When the cable connector is close toward the mating interface panel, the grounding arms abut against the panel thereby dissipating electrostatic charges accumulated on the cable connector and a cable terminated at the cable connector before the cable connector engages with the mating connector. The grounding arms will not adversely affect a mating dimension in a mating direction in which the cable connector is mated with the mating connector due to the resiliency of the grounding arms.

Other objects, advantages and novel features of the invention will become more apparent from the following detailed description when taken in conjunction with the accompanying drawings.

DETAILED DESCRIPTION OF THE INVENTION

Figure 1:
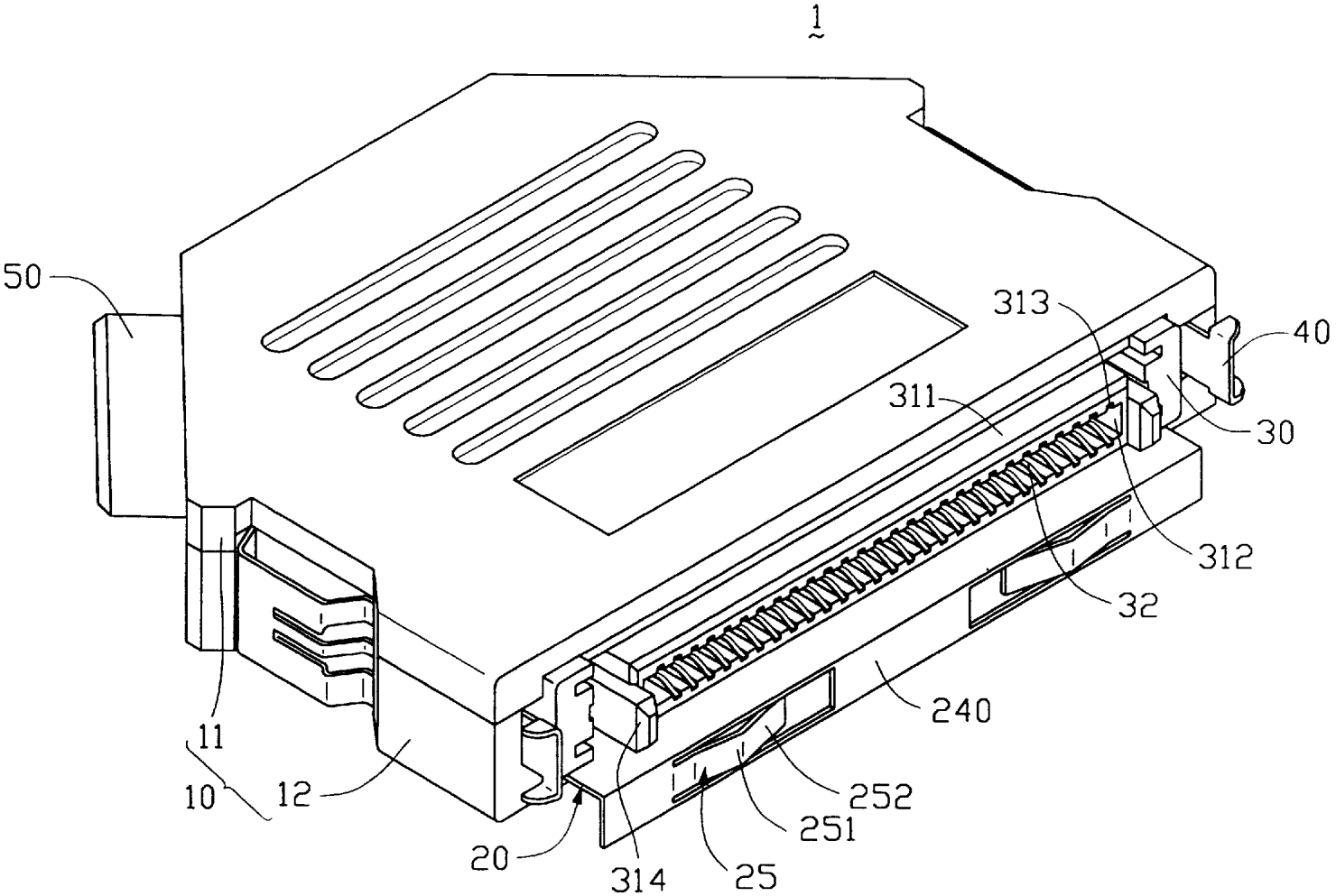
FIG. 1 is a perspective view of a cable connector of the present invention.

Referring to FIG. 1, a cable connector 1 in accordance with the present invention comprises a dielectric housing 30 receiving a plurality of contacts 32 therein, an outer shield module 10 consisting of an upper shield 11 and a lower shield 12, an inner shell module (not labeled) consisting of an upper shell (not shown) and a lower shell 20, a latching member 40, and a strain relief 50.

The housing 30 comprises a mating portion 311 defining an engaging slot 312. A pair of guiding posts 314 extends from opposite lateral ends of the mating portion 311 for guiding the cable connector 1 to be properly positioned when mating with an input/output interface panel 60 of an electronic instrument, such as a computer (not shown). A plurality of engaging grooves 313 are defined in opposite upper and lower walls of the engaging slot 312 for receiving mating ends of the corresponding contacts 32. The contacts 32 also have connecting ends opposite the mating ends for terminating at a cable (not shown). The cable comprises at least a grounding wire. The upper and lower shields 11, 12 are assembled together to enclose the housing 30, the upper shell and the lower shell 20.

Figure 2:
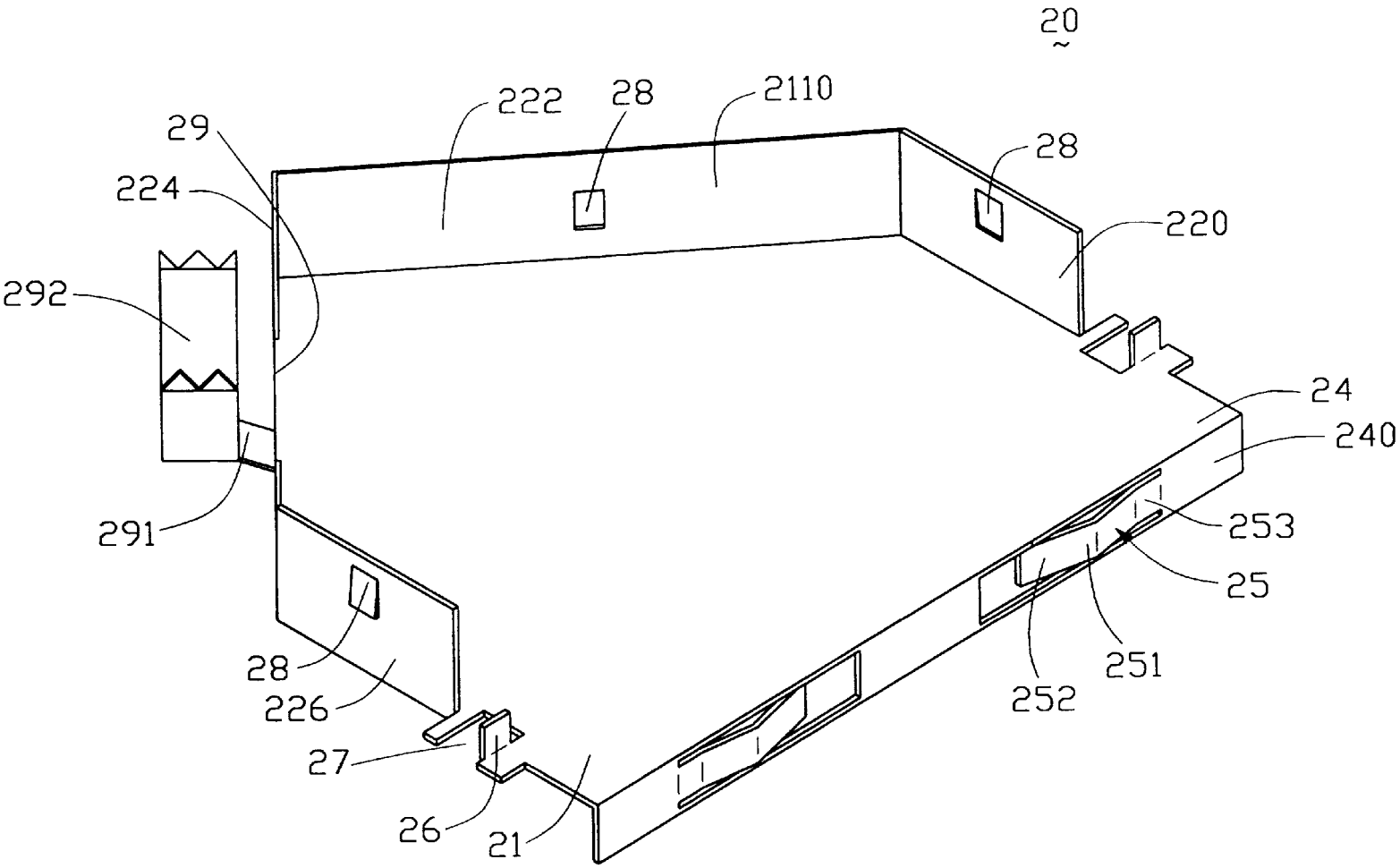
FIG. 2 is a perspective view of a shield of the present invention.

Referring also to FIG. 2, the lower shell 20 comprises a base plate 21 and four peripheral walls 220, 222, 224, 226 extending from outer edges thereof thereby defining a space 2110 therebetween for receiving the housing 30. A latching tab 28 outwardly extends from three of the peripheral walls 220, 222, 226 for abutting against side walls of the lower shield 12. An aperture 29 is defined in the peripheral wall 224 for insertion of the cable therethrough. A clasping ring 292 is connected with the periphery wall 224 via a connecting bar 291 for clasping the cable thereby preventing the cable from loosening and electrically contacting the grounding wires of the cable.

Figure 3:
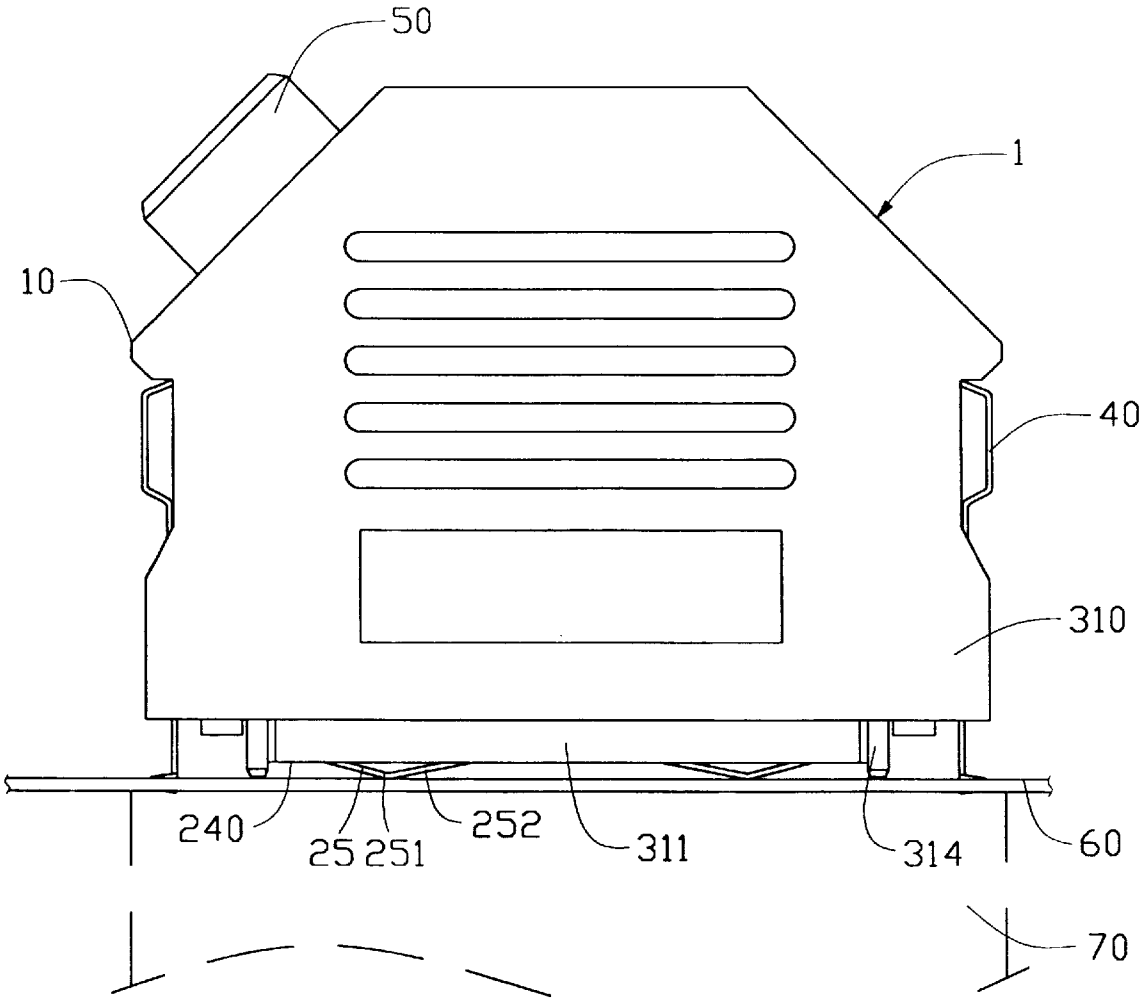
FIG. 3 is a bottom plan view of the cable connector before engaging with a mating connector.
Figure 4:
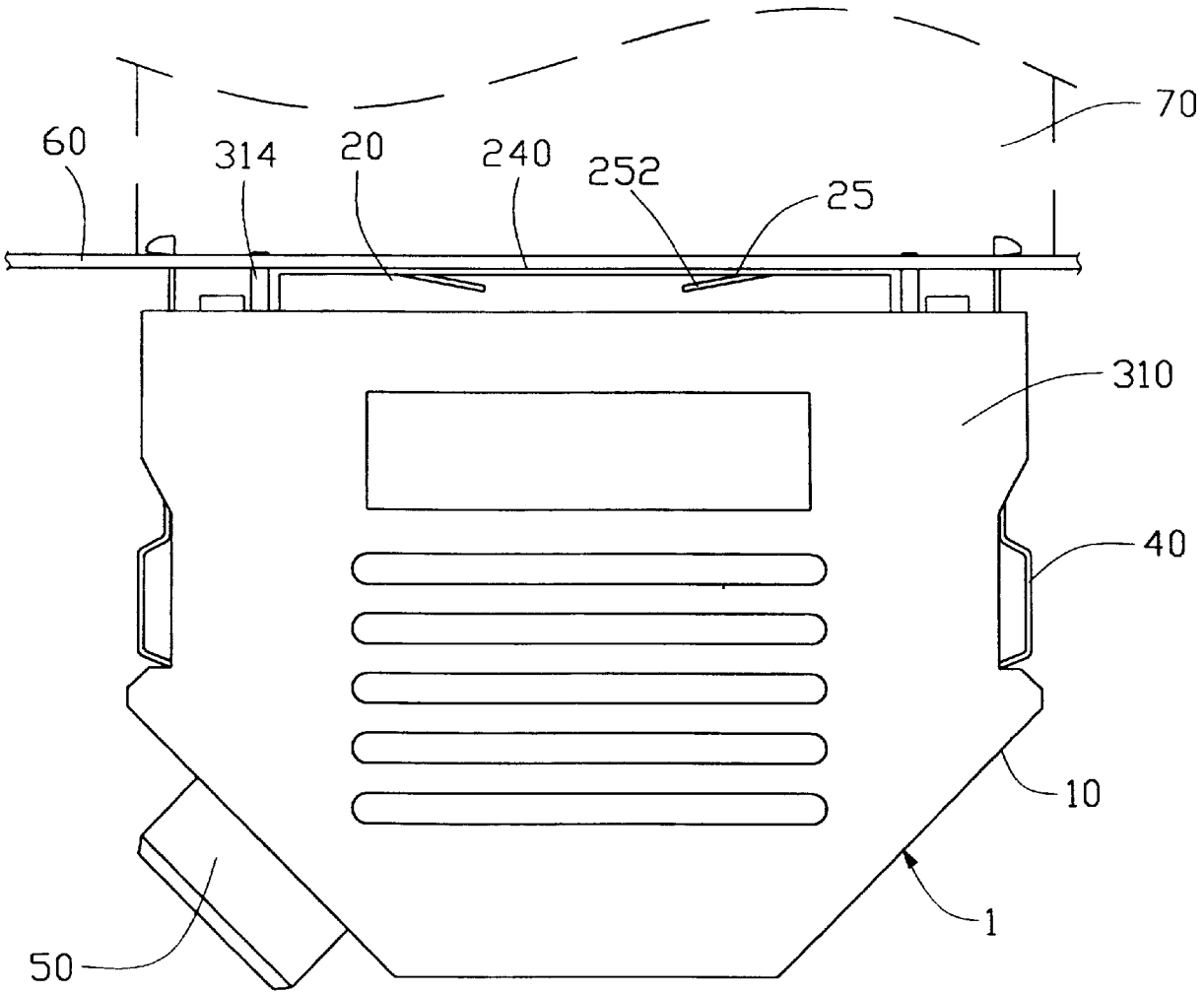
FIG. 4 is a bottom plan view of the cable connector after engaging with the mating connector.

A grounding portion 24 outwardly extends from the base plate 21 and beyond the mating portion 311. A vertical plate 240 is perpendicularly bent downwards from the base plate 21. The vertical plate 240 lies in the same plane as the free ends of the guiding posts 314 of the housing 30, or slightly beyond the free ends of the guiding posts 314. Understandably, the distance between the vertical plate 240 and the front edge of the outer shield module 10 should comply with the distance with which the mating portion 311 projects out of the front edge of the outer shield module 10 for not influencing the mating between the subject cable connector 1 and the mating connector 70 behind the mating interface panel 60 (FIGS. 3 and 4). A pair of V-shaped resilient grounding arms 25 is symmetrically formed on the vertical plate 240 and outwardly projects therefrom for contacting a mating interface panel 60 (FIGS. 3 and 4) of the computer. A cutout 27 and a latching tab 26 are formed at a junction between the peripheral walls 220, 226 and the grounding portion 24 for engaging with the outer shield 10.

The grounding arms 25 are symmetrically stamped from the vertical plate 240. Each grounding arm 25 comprises a connecting section 253 extending from the vertical plate 240, an outwardly projecting contacting section 251 extending from the connecting section 253 and slightly projecting beyond the vertical plate 240, and an inwardly bent free end 252 extending from the contacting section 251. The mating connector 70 is attached to the panel 60 with a mating section (not shown) extending through a mating port (not shown) defined in the panel 60 for mating with the cable connector 1. When the cable connector 1 is moved toward the panel 60 of the computer, the contacting section 251 of the grounding arms 25 abuts against the panel 60 thereby dissipating electrostatic charges accumulated on the cable connector 1 and the cable before the cable connector 1 engages with the mating section of the mating connector 70. The grounding arms 25 will not adversely affect a mating dimension in a mating direction in which the cable connector 1 engages with the mating connector 70 due to the resiliency of the grounding arms 25.

In assembly, the contacts 32 are received in the corresponding engaging grooves 313 of the housing 30. The housing 30 is enclosed by the upper shell and the lower shell 20. The grounding arms 25 slightly extend beyond the vertical plate 240 of the lower shell 20. The clasping ring 292 clamps the cable therein and electrically contacts the grounding wires of the cable. The upper and lower shields 11, 12 are assembled together to enclose the housing 30, the upper shell and the lower shell 20 within the outer shield 10 thereby ensuring excellent shielding effects. The latching members 40 and the strain relief 50 are simultaneously assembled to the cable connector. Thus, assembly of the cable connector in accordance with the present invention is completed.

Referring further to FIGS. 3 and 4 which are bottom plan views of the cable connector 1, the mating section of the mating connector 70 is covered by the guiding posts 314 and the grounding portion 24 of the lower shell 20, when the cable connector 1 is moved toward the panel 60 of the computer, the contacting sections 251 of the grounding arms 25 first electrically contact the panel 60 thereby forming a grounding loop via the grounding wires of the cable, the lower shell 20, the grounding arms 25, and the metallic panel 60 to dissipate electrostatic charges accumulated on the cable and the cable connector 1. The guiding posts 314 is aligned with and inserted into corresponding openings (not shown) defined in the panel 60.

The cable connector 1 is then moved to further enter into the mating section of the mating connector 70 by the guidance of the guiding posts 314 of the housing 30. The grounding arms 25 are easily depressed due to their resiliency. The contacting section 251 of the grounding arms 25 are pressed to move back toward the mating portion 311 of the housing 30 till being substantially in the common vertical surface of the outer end surface of the mating portion 311 of the housing 30, thereby not affecting a mating dimension in a mating direction in which the cable connector 1 is mated with the mating port of the panel 60. The free ends 252 are also simultaneously deflected back.

The grounding arms 25 can also be separately fabricated from the lower shell 20 and fixed to a similar position as described above for achieving substantially identical grounding effects to dissipate electrostatic charges accumulated on the cable and the cable connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector for electrically connecting a cable to a mating connector fixed to a metallic mating interface panel of an electronic instrument, the cable connector comprising:

a dielectric housing comprising a mating portion, the mating portion forming an outer surface at a free end thereof and defining a plurality of engaging grooves therein;

a plurality of contacts received in the engaging grooves; a lower metal shell comprising a receiving space for receiving the dielectric housing and a grounding portion aligned with the mating portion of the dielectric housing, a vertical plate being perpendicularly bent from the grounding portion, a pair of resilient grounding arms being formed on the vertical plate and outwardly extending for contacting the metallic mating interface panel of the electronic instrument before the mating portion engages with the mating section of the mating connector; and an outer shield module consisting of upper and lower, shields for enclosing the dielectric housing, the contacts and the lower shell;

wherein each grounding arm is V-shaped and comprises a connecting section extending from the vertical plate, an outwardly projecting contacting section extending from the connecting section for contacting the metallic mating interface panel, and an inwardly bent free end for allowing the grounding arm to deflect until lying substantially in the same plane as the vertical plate when the contacting section abuts against the metallic mating interface panel;

wherein the lower shell comprises an upwardly extending peripheral wall adjacent to the grounding portion and the receiving space is defined by the peripheral wall;

wherein a clasping ring extends from the peripheral wall of the lower shell for clasping the cable;

further comprising an upper metal shell for cooperating with the lower shell to enclose the dielectric housing.

2. The cable connector as claimed in claim 1, wherein a cutout and a latching tab are formed on opposite sides of a junction between the peripheral wall and the grounding portion for engaging with the upper shell.

3. The cable connector as claimed in claim 1, and wherein at least one tab outwardly extends from the peripheral wall for engaging with the lower shield of the outer shield module.

4. The cable connector as claimed in claim 1, wherein a pair of guiding posts extend from opposite lateral ends of the mating portion of the dielectric housing for guiding the cable connector to be properly positioned on the mating interface panel.

* * * * *